US006193822B1

(12) United States Patent
Nagashima et al.

(10) Patent No.: US 6,193,822 B1
(45) Date of Patent: Feb. 27, 2001

(54) METHOD OF MANUFACTURING DIESEL ENGINE VALVES

(75) Inventors: Tomotaka Nagashima, Toukai; Michio Okabe, Chita; Toshiharu Noda, Tajimi, all of (JP)

(73) Assignee: Daido Steel Co., Ltd., Nagoya (JP)

( * ) Notice: Under 35 U.S.C. 154(b), the term of this patent shall be extended for 0 days.

(21) Appl. No.: 09/099,205

(22) Filed: Jun. 18, 1998

(30) Foreign Application Priority Data

Jul. 3, 1997 (JP) ..... 9-178113

(51) Int. Cl.[7] ..... C22F 1/00
(52) U.S. Cl. ..... 148/677
(58) Field of Search ..... 148/677

(56) References Cited

U.S. PATENT DOCUMENTS 4,019,900 * 4/1977 Raghavan et al. ..... 75/171
4,547,229 * 10/1985 Larson et al. ..... 148/134
4,652,315 * 3/1987 Igarashi et al. ..... 148/12.7 R
4,741,080 * 5/1988 Larson et al. ..... 29/156.7 R
4,798,632 * 1/1989 Yonezawa et al. ..... 148/12.7 N
5,087,305 * 2/1992 Chang ..... 148/410
5,225,009 * 7/1993 Orikasa et al. ..... 148/677
5,413,752 * 5/1995 Kissinger et al. ..... 419/28
5,547,523 * 8/1996 Blankenship, Jr. et al. ..... 148/677

OTHER PUBLICATIONS

ASM Handbook, Tenth Edition, vol. 1, pp. 950–962, 983–985, 1990.*

* cited by examiner

*Primary Examiner*—Daniel J. Jenkins
(74) *Attorney, Agent, or Firm*—Varndell & Varndell, PLLC

(57) ABSTRACT

Disclosed is a method of manufacturing a diesel engine valve for intake and exhaust having good corrosion resistance and increased valve face strength, and therefore, of improved durability. A Ni-base heat resistant alloy of strong precipitation hardening type or an Fe-base heat resistant alloy of the same type is used as the material. The method comprises hot forging to prepare a blank form of the valve to be manufactured, solution treatment, cold processing to form the face part, and age-treating for increasing the hardness of the face part.

8 Claims, 1 Drawing Sheet

METHOD OF MANUFACTURING DIESEL ENGINE VALVES

BACKGROUND OF THE INVENTION

The present invention concerns a method of manufacturing diesel engine valves for both intake and exhaust having good corrosion resistance and strength.

In general, intake and exhaust valves for diesel engines are made of strong precipitation-hardening Ni-base heat resistant alloys represented by Nimonic 80A. It is a permanent problem to elongate valve lives, and there has been demand for further improvement in corrosion resistance and strength thereof. A typical process for manufacturing the valves conventionally practiced comprises hot forging at a temperature above 900° C. to form valve blanks, and solution treatment followed by age-hardening.

It is, however, inevitable that the steps for improving corrosion resistance and strength of the valve materials results in lowering processability and increase of manufacturing costs, and therefore, the improvement has been effected to only the face parts which require better properties. For example, the assignee developed and disclosed (Japanese Patent Publication No. 64-8099) a valve for marine diesel engines made by using a strong precipitation-hardening heat resistant alloy as the material, forming valve cone parts by forging at a temperature in the range of 700–900° C. under a forging degree of 20% or higher, and subjecting the forged products to age-hardening. It is also known to manufacture valves by forging at a temperature of 700–900° C., and solution treatment followed by partial cold processing.

In the practice of the above technology proposed by the assignee, because of a relatively low forging temperature of 700–900° C., cracking of materials at processing often occurs when the material is of low hot processability. Therefore, it is difficult to carry out forming with a high forging degree and to realize partial hardening to a desired high extent. In the other technology, in which partial cold processing follows solution treatment and age-hardening, the cold processing is the only way to increase strength, and unless strong processing is done at this stage, sufficient strength can not be obtained. However, limitation is posed on the forging degree at the cold processing to the valve blanks, which are already hardened to some extent by age-hardening, and thus, limitation is posed also on increase in the strength.

For the purpose of elongating valve lives not only strength but also corrosion resistance is an important factor. However, it is difficult to unite the strength and the corrosion resistance in the engine valves, because materials of high corrosion resistance generally have lower strength. Thus, it is concluded that, if partial strengthening of materials having good corrosion resistance could be made, this problem would be automatically solved.

SUMMARY OF THE INVENTION

The object of the present invention is to break through the above limit inherent in the conventional technology of manufacturing diesel engine valves and to provide an improved method of manufacturing which gives diesel engine valves having both higher strength and better corrosion resistance, and therefore, of longer lives.

The method of manufacturing diesel engine valves according to the present invention comprises: using a strong precipitation-hardening heat resistant alloy as the material, hot forging the material to prepare blank forms of the diesel engine valves, cold processing the face parts of the blanks, and age-treating the cold processed parts to enhance hardness thereof.

DETAILED EXPLANATION OF THE PREFERRED EMBODIMENTS

Figure 1:
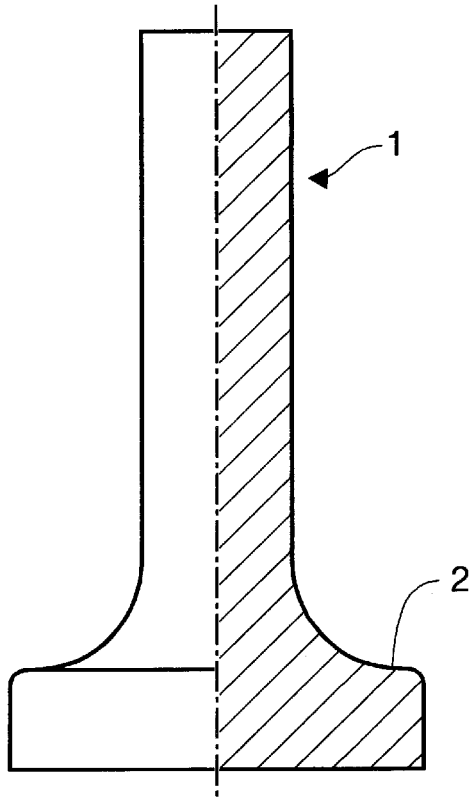
FIG. 1 is a side elevation view of an example of a blank of diesel engine intake/exhaust valve manufactured by the present invention, in which the half of the valve is shown in cross section.

The present invention encompasses the method comprising the steps described above and further a step of solution treatment after the hot forging and before the cold processing.

To the hot forging, which is carried out as the first step of the method of manufacturing valves from the strong precipitation-hardening heat resistant alloy, no particular limitation is given in regard to the heating temperature and the forging degree. In order to prevent coarsing of the crystal grains during heating it is preferable to carry out forging at a temperature as low as possible to process. In case where the forging is done at a temperature higher than a limit which resides in the range of 900–1100° C. it is not necessary to carry out the solution treatment subsequent to the forging. On the other hand, in case of low temperature forging, the solution treatment is necessary.

The solution treatment is done for the purpose of dissolving precipitates occurred during forging into the matrix and eliminating distortion formed during the processing. Usually, it is realized by soaking the work pieces at a temperature ranging from 1020 to 1080° C. for 1–18 hours. The soaking conditions are determined in view of the amounts of the precipitates and the extent of distortion formed during processing. As noted above, in case of high temperature forging, these factors are slight, and therefore, the solution treatment can be omitted.

The purpose of carrying out the partial cold processing is to promote precipitation hardening during the subsequent age-hardening by introducing transformations caused by processing. In order to achieve sufficient promotion it is necessary that the precipitates are sufficiently dissolved into the matrix, and the above solution treatment takes the role of dissolving precipitates. The effect of partial cold processing can be expected at a forging degree of 5% or higher and becomes more remarkable as the forging degree increases. At a forging degree exceeding 50% the effect saturates.

The last step of the process, age-hardening, is carried out by soaking the work pieces at a temperature of 600–800° C. for 1–18 hours. Preferable temperature is in the range of 700–750° C.

The strong precipitation-hardening heat resistant alloys used as the material of the diesel engine valves in the present invention are Ni-base and Fe-base heat resistant alloys having the following respective alloy compositions.

Ni-base Heat Resistant Alloy

The Ni-base heat resistant alloy consists essentially of, by weight %, C: up to 0.1%, Si: up to 1.0%, Mn: up to 1.0%, and Cr: 15–35%, and further, at least one of Ti: up to 3.0%, Al: up to 2.0% and Nb: up to 3.0%, and the balance of Ni.

A preferable alloy in the above composition ranges essentially consists of Cr: 25% or more but up to 32%, Ti: 2.0% or more but up to 3.0%, Al: 1.0–2.0% and the balance of Ni.

The following explains the roles of the alloy components and the reasons for limiting the alloy composition as noted above.

C: up to 0.1%

Carbon couples with titanium and chromium to form carbides, which are useful for increasing high temperature strength. Content of carbon more than 0.1% lowers ductility of the alloy and causes difficulty in processing. Thus, the above upper limit, 0.1%, is set.

Si: up to 1.0%

Silicon also contributes to increase of strength. Too much content thereof also lowers the ductility of the alloy, and therefore, the upper limit, 1.0%, is given.

Mn: up to 1.0%

Manganese prevents embrittlement of the alloy caused by sulfur therein. However, manganese promotes precipitation of η-phase ($Ni_3Ti$) which is harmful to the ductility, and the content should be limited to the upper limit, 1.0%.

Cr: 15–35%, preferably, higher than 25 up to 32%

Chromium is an essential element to heighten the corrosion resistance of the alloy, and to obtain this effect it is necessary to add 15% or higher of chromium. On the other hand, a content exceeding 35% will cause precipitation of the embrittling phase while the product valves are used. In case where the corrosion resistance is particularly important, it is recommended to choose a content of chromium higher than 25%. In order to avoid embrittlement during long period of use the content of chromium should be up to 32%. Thus, the above noted preferable range is decided.

One or more of Ti: up to 3.0%, Al: up to 3.0% and Nb: up to 3.0%; preferably, Ti: higher than 2.0% up to 3.0% and Al: 1.0–2.0%

Titanium, aluminum and niobium couple with nickel to precipitate γ-prime phase which enhances high temperature strength. Too high contents, however, cause embrittlement due to excess precipitation of the γ-prime phase during age-hardening, and further, lower hot processability. Thus, the respective upper limits, each 3.0%, were set. In case where the high temperature strength is particularly required it is recommended to use both Ti higher than 2.0% and Al of 1.0% or higher.

More preferable embodiments of the above described Ni-base heat resistant alloy further contain, in addition to any of the above described alloys, particularly of the preferable alloy compositions, one or both of B: up to 0.02% and Zr: up to 0.15%. The roles of these components and the reason for limiting the contents are as follows.

B: up to 0.02%

Boron segregates at crystal boundaries to increase creep strength and improves hot processability of the alloy. These effects can be obtained at a low content of boron. A higher content rather damages hot processability and therefore, the addition amount is limited to be up to 0.02%.

Zr: up to 0.15%

Zirconium, like boron, segregates at crystal boundaries and increases creep strength of the alloy. Too high a content of zirconium, however, rather damages the creep properties of the alloy, and therefore, addition amount should be up to 0.15%.

In the above Ni-base heat resistant alloy a part of nickel can be replaced with iron and/or cobalt. In case where Chromium is added in an amount exceeding 25%, it is necessary to choose an Fe-content less than 3.0%, for the purpose of stabilizing austenitic phase, so that the Ni-content may be relatively high. Cobalt contributes to stabilization of the austenitic phase as nickel does. Because cobalt is an expensive materiel, it is not advantageous to add much amount to the alloy. The upper limit is thus set to be 2.0%.

Fe-base Heat Resistant Alloy

The alloy consists essentially of, by weight %, C: up to 0.1%, Si: up to 1.0%, Mn: up to 10%, Ni: up to 30% and Cr: 12–25%, and further, at least one of Ti: up to 3.0%, Al: up to 2.0% and Mo: up to 4.0%, and the balance of Fe. Another alloy which further contains N: up to 0.5% is also useful. It is preferable to arrange Mn+Ni: 10–30%.

The following explains the roles of the alloy components and the reasons for limiting the alloy composition as above.

C: up to 0.1%, Si: up to 1.0%

The same as mentioned above in relation to the Ni-base heat resistant alloy.

Mn: up to 10%, Ni: up to 30%, preferably, Mn+Ni: 10–30%

Manganese is added for realizing austenitic phase in the alloy. Too much manganese reduces ductility of the alloy, and 10% is the upper limit of addition. Nickel is also an austenite-forming element, and added together with manganese. Addition amount is chosen in the range up to 30%, because nickel is relatively expensive as an alloying element. To ensure austenitic phase in the alloy it is preferable that the alloy contains 10% or more of Mn+Ni. From the view point of costs it is advisable to choose an addition amount of Mn+Ni up to 30%.

Ti: up to 3.0%, Al: up to 2.0%

In regard to titanium and aluminum the above description concerning the Ni-base heat resistant alloy is applicable to the Fe-base heat resistant alloy.

Mo: up to 4.0%

Molybdenum dissolves in the matrix of the alloy to strengthen it, therefore, a suitable amount thereof is added. Addition amount exceeding 4% may cause embrittlement of the alloy, and this is the upper limit.

N: up to 0.5%

Nitrogen is added with expectation of solid solution in the matrix and precipitation resulting in strengthening. Too much addition will cause embrittlement. The upper limit, 0.5%, is set from this view point.

Addition of boron and/or zirconium to the Fe-base heat resistant alloy is preferable as is to the Ni-base alloy, and the same merits can be obtained.

EXAMPLES

Alloys of the chemical compositions shown in Table 1 were prepared by melting in a vacuum induction furnace, and the molten alloys were cast into ingots weighing each 30 kg.

TABLE 1

| No. | C | Si | Mn | Ni | Cr | Ti | Al | Nb | Fe | Co | Others |
|---|---|---|---|---|---|---|---|---|---|---|---|
| 1 | 0.06 | 0.1 | 0.2 | bal. | 20 | 2.5 | 1.5 | — | — | — | — |
| 2 | 0.05 | 0.2 | 0.1 | bal. | 30 | 1.5 | 0.9 | — | — | — | — |
| 3 | 0.03 | 0.1 | 0.1 | bal. | 19 | 3.1 | 1.5 | — | — | 12 | — |
| 4 | 0.04 | 0.1 | 0.1 | bal. | 15 | 2.5 | 0.8 | 0.8 | 7 | — | — |
| 5 | 0.05 | 0.6 | 1.5 | 25 | 14 | 2.1 | 0.3. | — | bal. | — | Mo 1.3 |
| 6 | 0.40 | 0.2 | 9.2 | 4 | 21 | — | — | — | bal. | — | N 0.41 |
| 7 | 0.05 | 0.3 | 0.1 | bal. | 26 | 2.4 | 1.4 | — | 0.6 | 0.3 | — |
| 8 | 0.04 | 0.1 | 0.7 | bal. | 27 | 2.2 | 1.0 | — | 0.02 | 0.2 | — |
| 9 | 0.09 | 0.8 | 0.1 | bal. | 30 | 2.5 | 1.4 | — | 0.3 | — | B 0.004<br>Zr 0.064 |
| 10 | 0.04 | 0.2 | 0.7 | bal. | 32 | 2.9 | 1.4 | — | — | 0.03 | B 0.004<br>Zr 0.06 |
| 11 | 0.01 | 0.8 | 0.04 | bal. | 28 | 2.1 | 1.8 | — | 2.4 | 0.01 | B 0.014<br>Zr 0.06 |
| 12 | 0.03 | 0.3 | 0.3 | bal. | 26 | 2.3 | 1.2 | — | 29 | 1.8 | B 0.004 |

Figure 2:
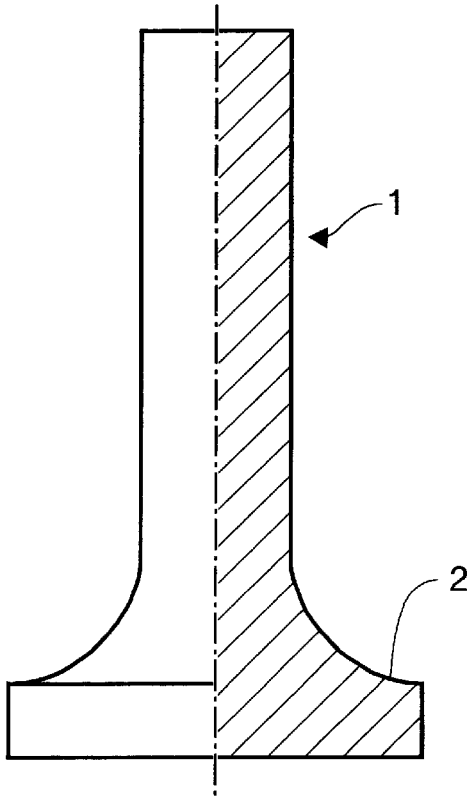
FIG. 2 illustrates the form of the intermediate product after cold forging the face part of the blank shown in FIG. 1.

The ingots were forged into round rods of a diameter 85 mm, and the rods were hot forged under the conditions shown below to be valve blanks having the shape illustrated in FIG. 1. The blanks were subjected to the heat treatment, and some of them were further subjected to cold forging on the face parts, as described below to give the shape illustrated in FIG. 2. Hardness of the face parts was determined.

| Processing Conditions | | |
|---|---|---|
| Example | 1) hot forging | forging temp. 700–1150° C. |
| | 2) solution treatment | 1050° C., 4 hours |
| | 3) face partial cold forging | forging degree 40% |
| | 4) age-hardening | 750° C., 16 hours |
| Control 1 | 1) hot forging | the same condition as above |
| | 2) solution treatment | the same condition as above |
| | 3) age-hardening | the same condition as above |
| Control 2 | 1) hot forging | forging temp. 700–900° C. |
| | 2) age-hardening | the same condition as above |
| Control 3 | 1) hot forging | forging temp. 700–1150° C. |
| | 2) solution treatment | 1050° C., 4 hours |
| | 3) age-hardening | 750° C., 16 hours |
| | 4) face partial cold forging | forging degree 40% |

Test pieces were cut from the manufactured valves and subjected to V(vanadium)-Attack Test and S(sulfur)-Attack Test under the following conditions.

V-Attack Test

Test pieces processed to length 25 mm, width 15 mm and thickness 5 mm were subjected abrasion with #500 emery paper, and then placed in a corrosive ash (a mixture of $V_2O_5$: 85%+$Na_2SO_4$: 15%). After soaking at 800° C. for 20 hours corrosion products on the test pieces were dissolved out and weight loss by corrosion was determined.

S-Attack Test

Test pieces of the same size as above were, after being abraded with the above emery paper, put in a mixed ash ($Na_2SO_4$: 90%+NaCl: 10%). Also, after soaking at 800° C. for 20 hours corrosion products on the test pieces were removed off and weight loss by corrosion was determined.

The results of the hardness test, S-attack test and V-attack test are shown in Table 2.

TABLE 2

| Alloy No. | Exmpl | Hardness (Hv) Cntrl 1 | Cntrl 2 | Cntrl 3 | V-Attack Test | S-Attack Test |
|---|---|---|---|---|---|---|
| 1 | 483 | 347 | 420 | 445 | 24.3mg | 135.2mg |
| 2 | 401 | 302 | 351 | 380 | 20.4 | 3.1 |
| 3 | 412 | 357 | 419 | 456 | 25.2 | 2.2 |
| 4 | 482 | 363 | 445 | 462 | 23.4 | 152.3 |
| 5 | 402 | 304 | 363 | 384 | 94.3 | 142.3 |
| 6 | 425 | 312 | 372 | 392 | 34.2 | 62.2 |
| 7 | 467 | 335 | 421 | 431 | 21.7 | 2.3 |
| 8 | 473 | 334 | crack*1 | 442 | 22.5 | 2.2 |
| 9 | 493 | 356 | crack*1 | crack*2 | 25.1 | 1.4 |
| 10 | 481 | 344 | crack*1 | 451 | 23.6 | 2.1 |
| 11 | 458 | 345 | 413 | 432 | 22.4 | 3.3 |
| 12 | 461 | 332 | 423 | 431 | 21.6 | 2.9 |

*1 crack occurred during hot forging

*2 crack occurred during cold forming of face part

From the data of Table 2 the following is concluded:

1) The valves manufactured in the working examples of this invention have faces harder than those of conventional products.
2) If the alloys Nos. 8–10 having low hot processability is processed by the conventional technology, crack will occur during the hot processing, and if the alloy No. 9 which exhibits high hardness after aging, crack will occur also during cold processing of the faces. The present method makes it possible to process these alloys to engine valves.
3) In cases where the alloys Nos. 7–12, which are preferable examples of the present invention, high hardness as well as good corrosion resistance are realized. Such results are also appreciated with No. 3 alloy, which contains much cobalt, while good results are obtained with the alloys Nos. 7–12, even though they contain no cobalt, and therefore, advantageous from the view point of costs.

We claim:

1. A method of manufacturing a diesel engine valve comprising: using a strong precipitation-hardening heat resistant alloy as the material, hot forging the material to prepare a blank form of the diesel engine valve, cold processing the face part of the blank, and age-treating the cold processed product so as to increase harness of the face part, wherein the material used is a Ni-base heat resistant alloy with strong precipitation-hardening used which consists essentially of, by weight %, C: up to 0.1%, Si: up to 1.0%, Mn: up to 1.0%, Cr: 25% or more but up to 32%, Ti: 2.0% or more but up to 3.0%, Al: 1.0%–2.0% and Nb: up to 3.0%, and the balance of Ni.

2. A method of manufacturing a diesel engine valve according to claim 1, wherein the Ni-base heat resistant alloy used contains, in addition to the alloy components set forth in claim 1, one or both of B: up to 0.02% and Zr: up to 0.15%.

3. A method of manufacturing a diesel engine valve according to claim 1, wherein the material used is an Fe-base heat resistant alloy with strong precipitation-hardening, which consists essentially of, by weight %, C: up to 0.6%, Si: up to 1.0%, Mn: up to 10%, Ni: up to 30% and Cr: 25–30%, and further, at least one of Ti: up to 3.0%, Al: up to 2.0% and Mo: up to 4.0%, and the balance of Fe.

4. A method of manufacturing a diesel engine valve according to claim 3, wherein the Fe-base heat resistant alloy used contains, in addition to the alloy components set forth in claim 3, N: up to 0.5%.

5. A method of manufacturing a diesel engine valve comprising: using a strong precipitation-hardening heat resistant alloy as the material, hot forging the material to prepare a blank form of the diesel engine valve, subjecting the blank to solution treatment, cold processing the face part of the blank, and age-treating the cold processed product so as to increase harness of the face part, wherein the material used is a Ni-base heat resistant alloy with strong precipitation-hardening used which consists essentially of, by weight %, C: up to 0.1%, Si: up to 1.0%, Mn: up to 1.0%, Cr: 25% or more but up to 32%, Ti: 2.0% or more but up to 3.0%. Al: 1.0%–2.0% and Nb: up to 3.0%, and the balance of Ni.

6. A method of manufacturing a diesel engine valve according to claim 5, wherein the Ni-base heat resistant alloy used contains, in addition to the alloy component set forth in claim 5, one or both of B: up to 0.02% and Zr: up to 0. 15%.

7. A method of manufacturing a diesel engine valve according to claim 5, wherein the material used is an Fe-base heat resistant alloy with strong precipitation-hardening, which consists essentially of, by weight %, C: up to 0.6%, Si: up to 1.0%, Mn: up to 10%, Ni: up to 30% and Cr: 12–25%, and further, at least one of Ti: up to 3.0%, Al: up to 2.0% and Mo: up to 4.0%, and the balance of Fe.

8. A method of manufacturing a diesel engine valve according to claim 7, wherein the Fe-base heat resistant alloy used contains, in addition to the alloy component set forth in claim 7, N: up to 0.5%.

* * * * *